US009776780B2

(12) United States Patent
Schloesser et al.

(10) Patent No.: US 9,776,780 B2
(45) Date of Patent: Oct. 3, 2017

(54) METHOD OF SHRINK PACKAGING A SERIES OF CONTAINERS WITH A PERFORATED SHRINK FILM

(71) Applicant: DIOPASS SPRL, Jalhay (BE)

(72) Inventors: Henry Frederic Schloesser, Jalhay (BE); Paula Mireille Fluzin, Jalhay (BE)

(73) Assignee: DIOPASS SPRL, Jalhay (BE)

( * ) Notice: Subject to any disclaimer, the term of this patent is extended or adjusted under 35 U.S.C. 154(b) by 0 days.

(21) Appl. No.: 14/415,566

(22) PCT Filed: Jul. 19, 2013

(86) PCT No.: PCT/EP2013/065274
§ 371 (c)(1),
(2) Date: Jan. 16, 2015

(87) PCT Pub. No.: WO2014/013049
PCT Pub. Date: Jan. 23, 2014

(65) Prior Publication Data

US 2015/0225154 A1 Aug. 13, 2015

(30) Foreign Application Priority Data

Jul. 20, 2012 (BE) ..... 2012/0507

(51) Int. Cl.
*B65B 61/02* (2006.01)
*B65B 53/02* (2006.01)
(Continued)

(52) U.S. Cl.
CPC ..... *B65D 71/08* (2013.01); *B65B 35/44* (2013.01); *B65B 41/00* (2013.01); *B65B 41/12* (2013.01);
(Continued)

(58) Field of Classification Search
CPC ..... B65B 53/00–53/066; B65B 35/44; B65B 41/12; B65B 61/02; B65B 61/025;
(Continued)

(56) References Cited

U.S. PATENT DOCUMENTS 3,014,634 A * 12/1961 Humphrey et al. ... B65D 5/724 119/430
3,394,865 A * 7/1968 Leblanc ..... B65D 85/327 206/521.15
(Continued)

FOREIGN PATENT DOCUMENTS

DE 102007033101 A1 * 1/2009 ..... B65B 61/18
FR 2161444 A5 * 7/1973 ..... B65B 61/18
(Continued)

OTHER PUBLICATIONS

EPO machine translation of FR 2161444, retrieved May 6, 2016, 14 pages.*
(Continued)

*Primary Examiner* — Stephen F Gerrity
(74) *Attorney, Agent, or Firm* — Koppel, Patrick, Heybl & Philpott

(57) ABSTRACT

The invention relates to shrink packaging (1) for packing a series of containers (2), said packaging comprising a first zone (3) and, in this zone, at least one incision line including a series of perforations forming at least one partially detachable section (4) arranged to allow the extraction of at least one container (2) in a direction extending substantially from the lower part of the container (2) to the upper part thereof, said partially detachable packaging section (4) being larger than the cross-section of the at least one container (2) to be extracted. Moreover, the partially detachable section (4) is located on the periphery of the first zone (3).

3 Claims, 7 Drawing Sheets

(51) Int. Cl.

| | |
|---|---|
| ***B65B 41/12*** | (2006.01) |
| ***B65B 35/44*** | (2006.01) |
| ***B65B 61/18*** | (2006.01) |
| ***B65D 71/08*** | (2006.01) |
| ***B65B 41/00*** | (2006.01) |
| ***B65D 21/02*** | (2006.01) |
| ***B65D 75/00*** | (2006.01) |
| ***B65D 75/52*** | (2006.01) |

(52) U.S. Cl.
CPC ..... *B65B 53/02* (2013.01); *B65B 61/025* (2013.01); *B65B 61/18* (2013.01); *B65D 21/0201* (2013.01); *B65D 75/002* (2013.01); *B65D 75/006* (2013.01); *B65D 75/527* (2013.01); *B65D 2301/20* (2013.01); *B65D 2571/00574* (2013.01); *B65D 2571/00679* (2013.01)

(58) Field of Classification Search
CPC ..... B65B 61/18; B65B 21/245; B65D 71/08; B65D 75/002; B65D 75/527; B65D 2301/20; B65D 2571/00679; B65D 2571/00574; B65D 2571/0058
USPC ..... 53/442, 556, 448, 543, 411, 131.5, 412, 53/133.1, 133.3, 133.8; 206/432, 497; 229/87.01, 87.05
See application file for complete search history.

(56) References Cited

U.S. PATENT DOCUMENTS 3,488,913 A * 1/1970 Burgess ..... B65B 53/00 206/432
3,542,193 A * 11/1970 Hewlett et al. ..... B65D 71/10 206/459.5
3,750,876 A * 8/1973 Throberg ..... B65D 71/10 206/432
3,881,089 A * 4/1975 Harkness et al. ..... B65B 53/02 219/385
4,077,516 A * 3/1978 Duerr ..... B65D 71/0085 206/432
4,078,659 A * 3/1978 Rensner ..... B65B 61/14 206/432
4,289,236 A * 9/1981 Ganz et al. ..... B65B 53/02 206/432
4,405,044 A * 9/1983 Flower et al. ... A61B 17/06061 206/738
4,586,312 A 5/1986 Limousin
4,860,893 A * 8/1989 Kaufman ..... B65D 33/24 206/390
5,048,687 A * 9/1991 Suzuki et al. ..... B65D 71/10 206/494
5,154,289 A * 10/1992 Van Erden ..... B65D 71/504 206/150
5,452,798 A * 9/1995 Kraft ..... B65D 71/0085 206/192
5,685,428 A * 11/1997 Herbers et al. .... B65D 71/0085 206/391
6,050,058 A * 4/2000 Loreto et al. ..... B65D 75/527 206/432
6,722,103 B2 * 4/2004 Gambetti ..... B65B 11/10 53/411
7,942,263 B2 * 5/2011 Block ..... B65D 71/10 206/432
2008/0264818 A1 * 10/2008 Dubosq et al. ..... B65D 71/10 206/432
2008/0302692 A1 * 12/2008 Dubosq et al. ..... B65D 71/066 206/427
2011/0215016 A1 9/2011 Block
2015/0197384 A1 * 7/2015 Schloesser et al. ... B65D 71/08 206/497

FOREIGN PATENT DOCUMENTS

FR 2387172 A1 * 11/1978 ..... B65D 71/10
GB 547267 A * 8/1942 ..... B26D 9/00
NL 1 005 648 C2 9/1998
WO WO 9921775 A1 * 5/1999 ..... B65D 51/185
WO WO 99/46180 A1 9/1999
WO WO 03053804 A2 * 7/2003 ..... B26F 1/20
WO WO 2011151245 A1 * 12/2011 ..... B23K 26/046

OTHER PUBLICATIONS

EPO machine translation of DE 102007033101, retrieved May 6, 2016, 7 pages.*
International Search Resort for PCT/EP2013/065274 mailed Sep. 30, 2013, 6 pages.

* cited by examiner

METHOD OF SHRINK PACKAGING A SERIES OF CONTAINERS WITH A PERFORATED SHRINK FILM

The present invention relates to the field of shrink packaging provided to cover a series of containers comprising an upper part provided with an opening and a lower part corresponding to a bottom, opposite said upper part, said containers being arranged in parallel rows, comprising at least one first zone covering an upper part of said containers, in particular at their opening, and a second zone covering the underside of said containers at their bottoms.

This type of packaging is not practical for consumers who wish for example to purchase a single container. In that scenario, the consumer is obligated to break part of the shrink packaging in order to remove the desired container therefrom. The quantity of plastic material generally used is provided to protect and manipulate the packaging comprising the containers. However, the packaging is not provided to remove a certain quantity of containers from the packaging. Consequently, when the consumer breaks part of the packaging, it is more difficult for consumers and store employees to move on it the store shelves. Furthermore, when a consumer breaks the packaging, the rest of the packaging may no longer protect or sufficiently contain the other containers, which are no longer adequately maintained inside the packaging. The usefulness of this type of packaging is greatly limited at this time.

Currently, a packaging exists that does not have the aforementioned drawbacks. The packaging is for example known from document WO 2003/053804. That document discloses packaging with a heat shrinkable film for bottles in which a length of said film is wound and heat shrunk around said bottles and on which a series of incisions is provided on said film. Said incisions form at least two parallel rows of aligned incisions located between each plane separating adjacent rows of bottles.

Often, a central handle is positioned on the upper side of the packaging, between two series of two parallel rows of incisions.

Unfortunately, this type of film packaging makes it difficult to handle said packaging when it is transported, during production (conveying, palletization) and during placement on the shelves before and after the incisions present on the film are broken. In fact, said packaging is made fragile at said incisions present in zones located between series or rows of bottles. Consequently, the surrounding environment (friction, roughness and obstacles) can tear the packaging at said incisions, making the packaging much more fragile, as does the weight of the bottles or the pulling force exerted on either side of the series of incisions when the handler or consumer carries a package of several containers.

In a warehouse, it is often necessary to be able to transport said film packaging quickly and easily without risking an instantaneous break of said packaging during manipulation thereof, for example to place it on shelves. The known packaging has an instantaneous tear risk that is difficult for the consumer or employee to control.

Furthermore, in a warehouse, the movement of this type of packaging, made fragile by the presence of said incisions around the bottles, makes it difficult to manipulate both during palletization and during conveying. The fragile packaging no longer makes it possible to guarantee protection of the bottles contained in the packaging after the incisions are broken because its strength is greatly reduced.

Lastly, this type of packaging, which is provided so that the consumer can remove a row of containers from a packaging without disrupting the alignment of the containers remaining in the packaging, does not work. In fact, for example in packages of 2×3 rows of bottles, two series of two parallel incision lines are provided between each row of bottles. Furthermore, the consumer is forced to take one complete row of bottles. When the consumer removes a row of two bottles, for example corresponding to his need, he for example tears the packaging along the first series of two parallel incision lines and thus leaves the two remaining rows of two bottles in the packaging, for example on the pallet provided to that end. Although one side of those rows is kept firmly around the bottles, that is not the case for the other, where the bottles are no longer laterally maintained. In fact, on the one hand the packaging is expanded by the tearing, but on the other hand it is not cold elastic and no longer offers the ability to keep the containers together. The next consumer may need a complete package and may therefore have to move that partial package aside, which he will lift by the handle. This then contributes to additional deformation of the unprotected side of the packaging and falling or misalignment of the remaining bottles, thereby creating chaos and disorder on the pallet.

Disorder is typically not attractive for consumers, who are no longer tempted by those bottles and will often then prefer to tear open a new package to remove the necessary row(s). This effect, well known by large stores, requires the continual presence of handlers to arrange the shelves and collect the torn packaging parts, which are unattractive when strewn on the floor. Additionally, the risk of containers positioned at heights on the pallets falling onto consumers' feet or children is yet another reason this type of packaging and the product it contains may be unattractive to consumers.

The invention aims to offset the drawbacks of the state of the art by procuring an invention making it possible to decrease the fragility of the packaging in order to make it easier to handle (transport, palletization, conveying, shelving). The invention therefore provides a packaging that guarantees lateral maintenance around the bottles before and after said incision lines are broken.

To resolve this problem, according to the invention, a shrink packaging is provided as indicated at the beginning of this document, characterized in that it comprises, on said first zone, at least one incision line comprising a series of perforations forming at least one partially detachable section arranged to allow the removal of at least one container in a direction extending substantially from the lower part of the container toward the upper part thereof, said partially detachable packaging section being larger than the cross-section of the at least one container to be removed, said partially detachable section being located on the periphery of the first zone.

The presence of at least one incision line on the periphery of the first zone makes it possible to effectively decrease the risks of sudden perforations of the packaging. The first zone is situated at the opening of the containers, which makes it possible to decrease the risk of sudden tearing during various manipulations (during conveying, palletization, shelving, transport by a consumer or employee) before or after breaking said incision line.

In the context of the present invention, said incision line comprising a series of perforations forming at least one partially detachable section situated on the periphery of said first zone on the one hand makes it possible to reduce the exposure of said incision line to the surrounding environment such that the tear risk is reduced, and on the other hand facilitates the removal of a container from the packaging in a direction substantially oriented from the lower part of the container toward the upper part. Furthermore, the location of at least one partially detachable section on the periphery of said first zone reduces the fragilization of the rest of the packaging and also makes it possible to maintain the strength of the packaging even after tearing of said incision lines, owing to lateral maintenance preserved around the containers. In fact, when said incision is broken, a central base situated in the first zone of the packaging is maintained, thereby making it possible to retain a shape similar to the starting shape (before break). Consequently, the manipulation of said packaging is then facilitated through the preservation of the strength thereof even after said incision is broken owing to the lateral maintenance of the containers. Furthermore, according to the present invention, when a handle is present on the heat shrinkable packaging, it bears on the lateral sides not provided with incision lines, unlike in the known state of the art, and thereby avoids biasing the parts on either side of the incision line and thus avoids accidental tearing during carrying of the packaging.

Advantageously, said partially detachable packaging section is completely detachable. This makes it possible to further facilitate the removal of the container present in the packaging.

In one particular embodiment, said incision line on the periphery of said first zone comprises a priming part arranged to facilitate priming of said partially detachable packaging section, for example a more dense incision, an opening or a tab. A priming part makes it possible to prevent the user from using his own means to break the incision line. The presence of a tab, for example, makes it possible to facilitate the opening of said packaging at the incision line provided to that end.

Preferably, said incision line has a shape that is circular, oval, linear, arc of circle, square with rounded corners, rectangular with rounded corners, hexagonal with rounded corners, or a finite curved line with an irregular shape, allowing the container to be removed outside said partially detachable packaging section.

Preferably, the containers according to the present invention are chosen from the group made up of cans, cardboard boxes of the single-serving carton or Tetrapack® type, glass or plastic bottles. In fact, globally, any type of shape can be provided inasmuch as the partial detachment allows at least one container to be removed from a packaging containing a series of containers.

Other embodiments of the packaging are mentioned in the appended claims.

The present invention also relates to a method for manufacturing a shrink packaging for a series of containers comprising the following steps:

- unwinding a shrink film on a conveyor belt,
- positioning said containers on said conveyor belt, in parallel rows,
- bundling said containers using said shrink film, thus forming a shrink film coating around said containers, and
- heat treating said shrink film in order to keep said containers tight against each other.

The method according to the invention is characterized in that it further comprises an incision step along a trajectory corresponding to an incision line comprising a series of perforations forming at least one partially detachable section arranged to remove, in a direction substantially oriented from the lower part of the container toward the upper part, at least one container, said partially detachable packaging section having a size larger than or equal to the section of said at least one container to be removed, said at least [one] partially detachable section being located on the periphery of said first zone.

Advantageously, the method according to the invention is characterized in that the incision step is performed before said unwinding of the shrink film.

In one alternative within the meaning of the present invention, said incision is done during or after unwinding of the film, for example before or after shrinking said shrink film.

More preferably, the method according to the invention is characterized in that said incision is made using a tracing wheel articulated on an arm that can be manipulated to trace said trajectory, using a cutting punch, or by laser.

Preferably, the method according to the invention further comprises printing a pattern on said film before said unwinding said shrink film.

Other embodiments of the method according to the invention are indicated in the appended claims.

The invention also relates to a shrink film blank provided to cover a series of containers, characterized in that it comprises, on said first zone, at least one incision line comprising a series of perforations forming at least one partially detachable section arranged to remove at least one container in a direction substantially oriented from the lower part of the container toward the upper part, said partially detachable packaging section having a size larger than or equal to the section of said at least one container to be removed, said at least one partially detachable section being located on the periphery of said first zone.

Advantageously, said partially detachable packaging section is completely detachable.

Preferably, said incision line on the periphery of said first zone comprises a priming part arranged to facilitate priming of the partially detachable packaging section, for example a more dense incision, an opening or a tab.

In another embodiment, said incision line has a shape that is circular, oval, linear, arc of circle, square with rounded corners, rectangular with rounded corners, hexagonal with rounded corners, or a finite curved line with an irregular shape, allowing the container to be removed outside said partially detachable packaging section.

Advantageously, said containers are chosen from the group made up of cans, cardboard boxes of the single-serving carton or Tetrapack® type, glass or plastic bottles. In fact, globally, any type of shape can be provided inasmuch as the partial detachment allows at least one container to be removed from a packaging containing a series of containers.

Other embodiments of the shrink packaging blank according to the invention are indicated in the appended claims and figures.

The present invention also relates to an assembly comprising a shrink packaging according to the invention and a series of containers arranged in parallel rows.

Other embodiments of the assembly according to the invention are indicated in the appended claims.

Other features, details and advantages of the invention will emerge from the following description, provided non-limitingly and in reference to the appended drawings.

Figure 4:
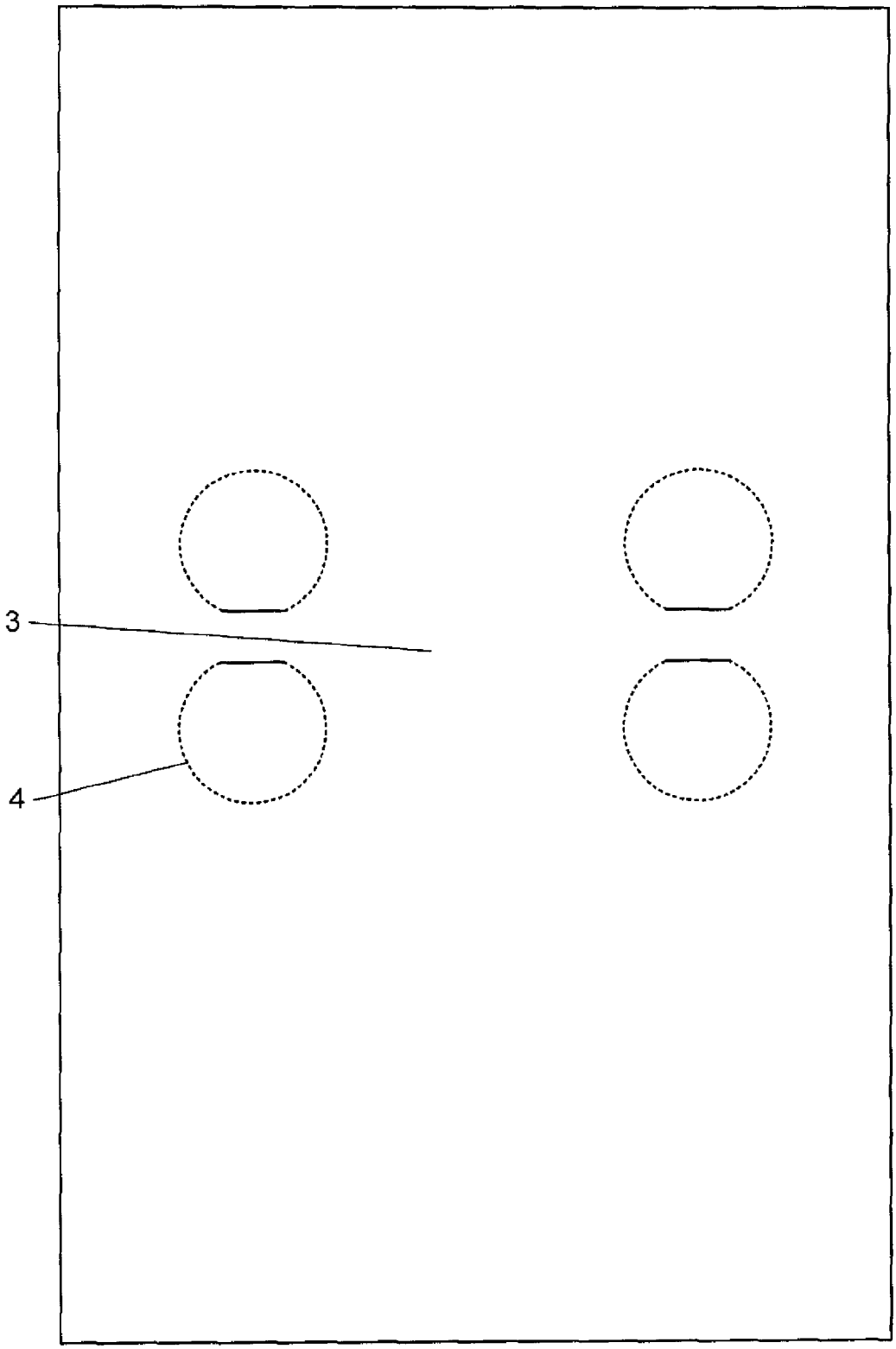
FIG. 4 is a top diagrammatic view illustrating a packaging blank according to the invention comprising four incision lines on the periphery.
Figure 4A:
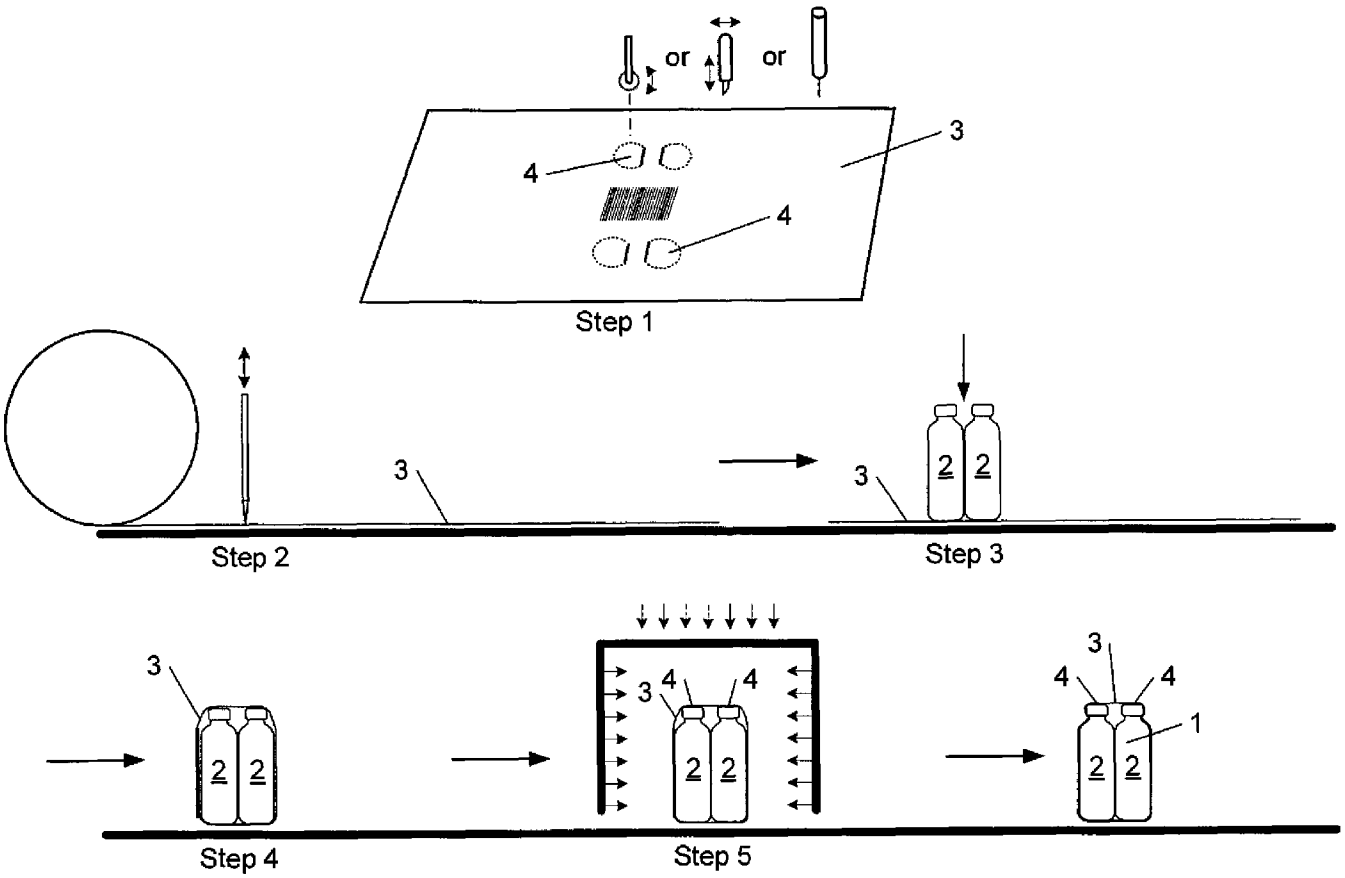

FIG. 4*a* is diagram for an embodiment of a method according to the invention.

Figure 5:
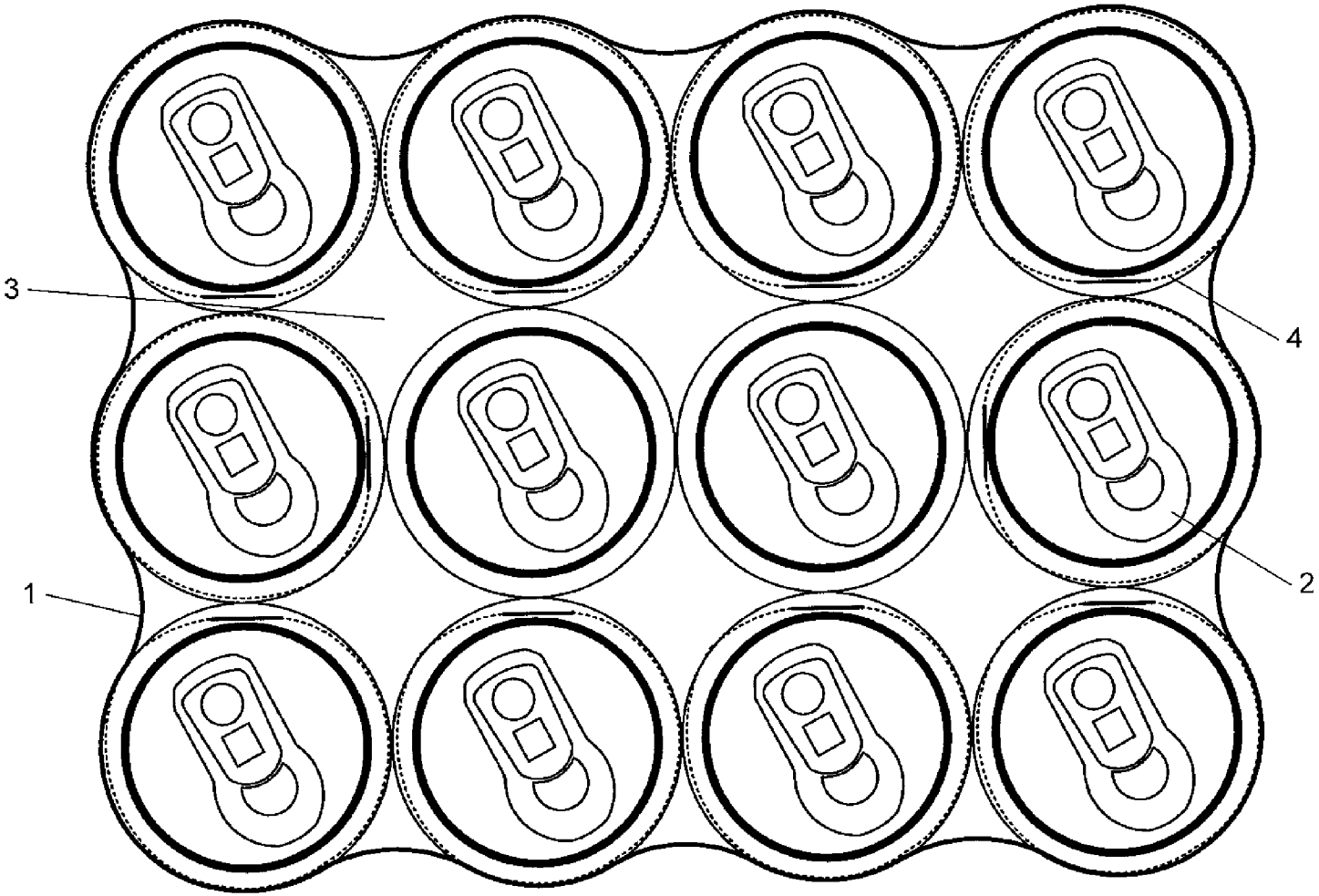

FIG. 5 is a top diagrammatic view illustrating a packaging comprising twelve cans, several partially detachable packaging sections of which (ten in FIG. 5) are situated on the periphery of a first zone situated at the opening of the cans.

Figure 6:
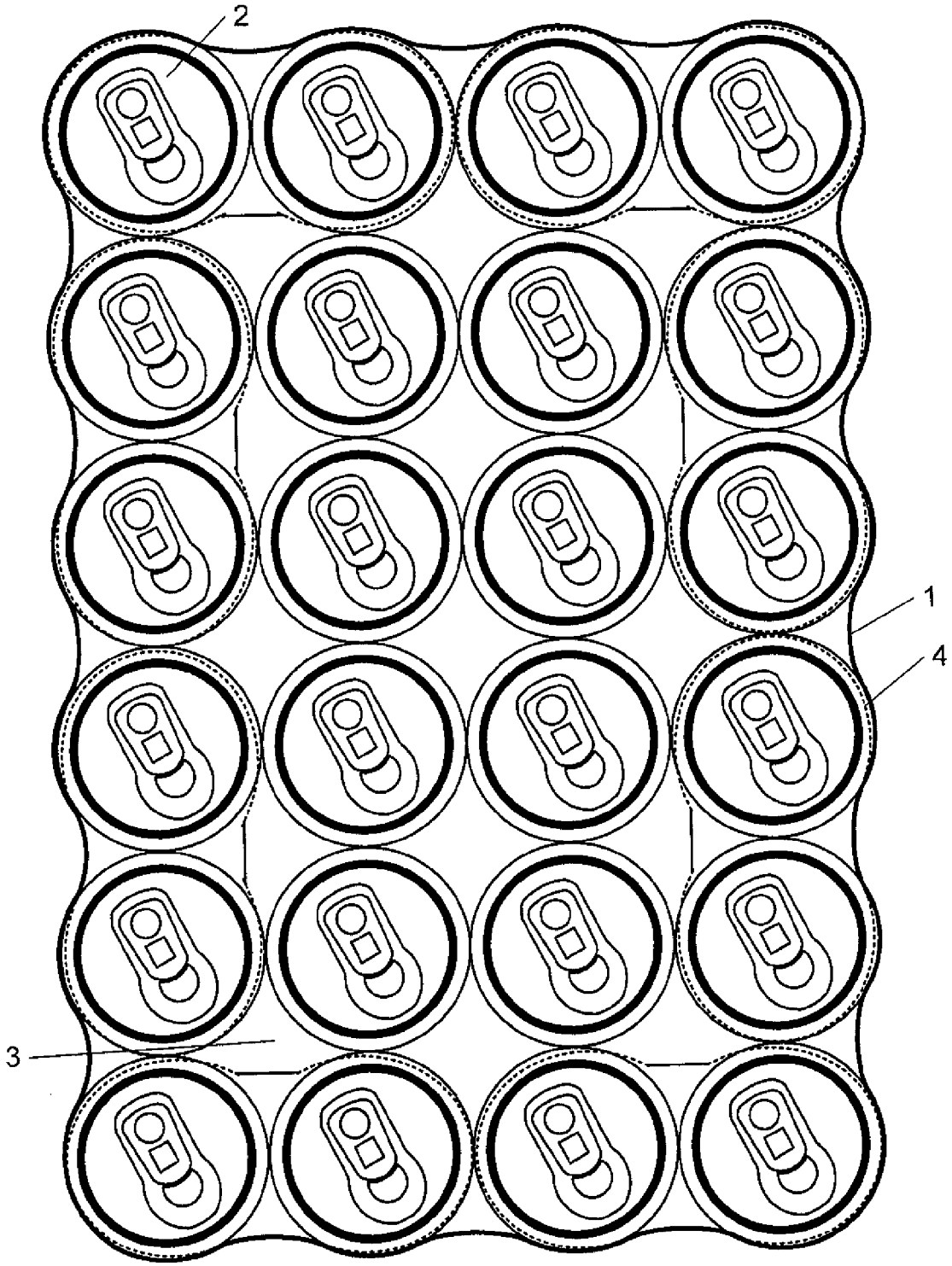

FIG. 6 shows a packaging provided for 24 cans comprising several partially detachable packaging sections (eight in FIG. 6) situated on the periphery of a first zone situated at the opening of the cans.

In the figures, identical or similar elements bear the same references.

Figure 1:
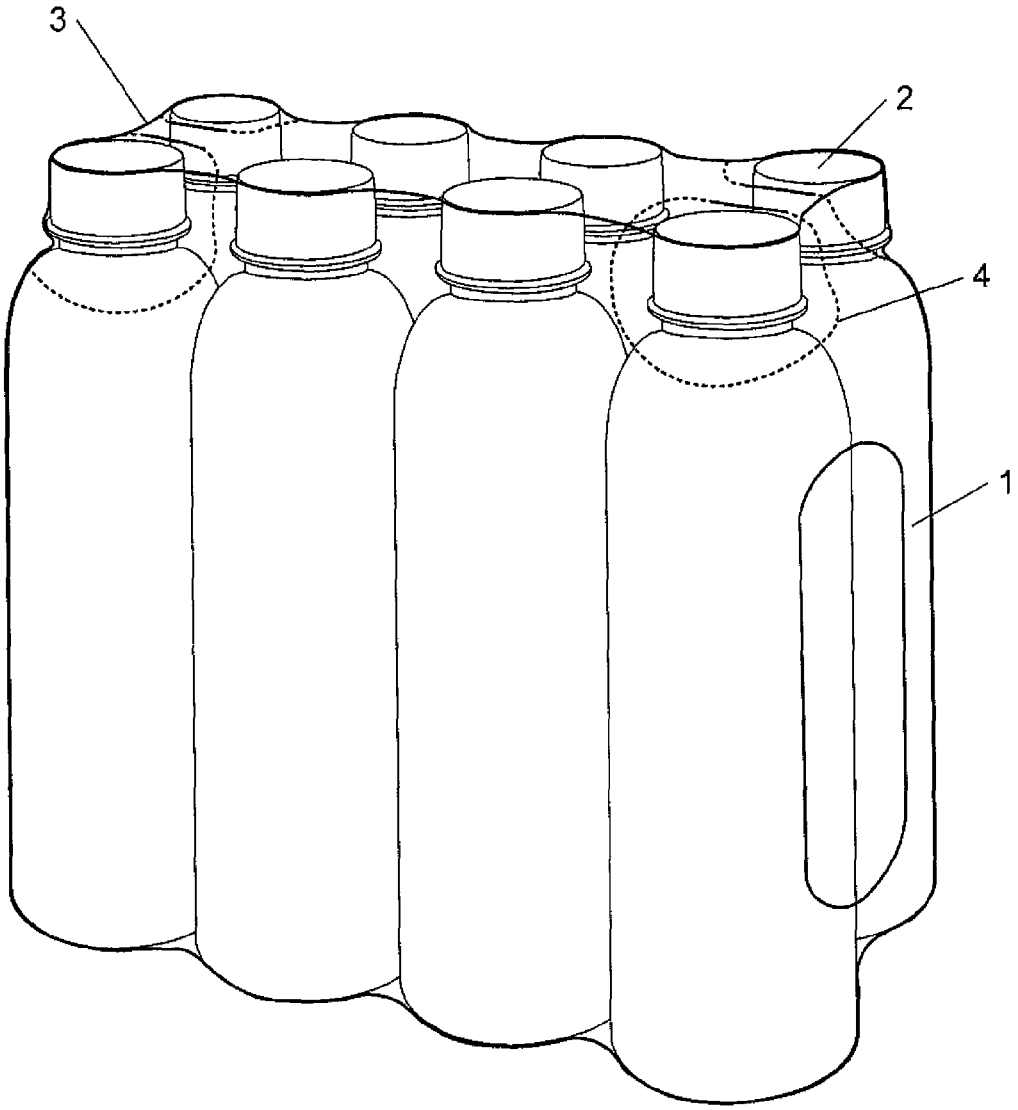
FIG. 1 is a transparent view of a shrink packaging according to the invention comprising eight bottles.

FIG. 1 illustrates a shrink packaging 1 comprising eight bottles 2 and a first zone 3 situated at the opening of said bottles. The shrink packaging 1 also comprises, on said first zone 3, four incision lines containing a series of perforations that form a total of four partially detachable packaging sections 4, located on the periphery of said first zone 3.

Within the meaning of the present invention and as previously mentioned, the incision lines comprise a series of incisions with similar or different shapes. The shape of the incisions may be round, oval, etc., or rectangular, in the form of bars, or any combination thereof. Furthermore, the incision lines may also be slots that allow access to said containers.

Perforating a partially detachable packaging section 4 makes it possible to access the bottles 2 easily. Next, the rest of the packaging 1 retains its rigidity, because a small quantity of plastic material has been broken at the ends of said packaging 1, making it possible to carefully preserve the rest of the bottles 2 owing to lateral maintenance.

The placement of the four incision lines on the periphery of said packaging 1 makes it possible to reduce the risks of rupture at said incisions that may occur during manipulation (hooks, nails present on the shelves, shelving, palletization, conveyance, etc.).

Figure 2:
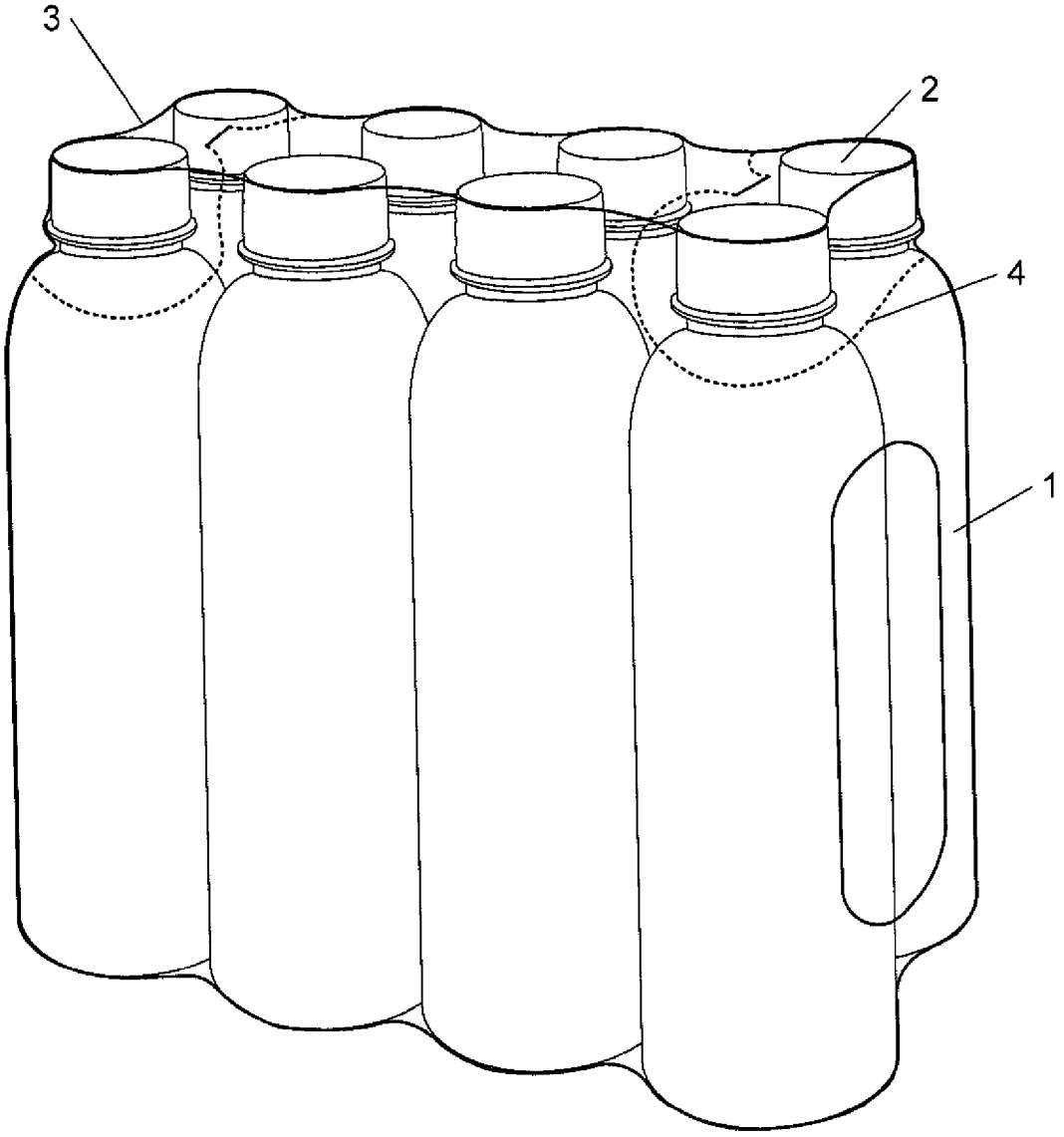
FIG. 2 is a perspective view of an alternative of the shrink packaging according to the invention.

FIG. 2 illustrates the same elements as those described in FIG. 1, except that the packaging 1 contains two rows of rectangular incisions with rounded corners containing a series of perforations that delimit a total of two partially detachable packaging sections 4 located on the periphery of said first zone 3.

This figure sheds light on another manner of producing the packaging 1 according to the present invention. In fact, the partially detachable packaging section 4 makes it possible to form an opening larger than that of FIG. 1 because the incision lines pass through two bottles 2.

It is also advisable to use this type of incision line surrounding two containers according to FIG. 2 in order to facilitate the removal of containers, such as cardboard boxes provided to contain milk.

After breaking the incisions containing a perforation series of each partially detachable packaging section 4 (two in FIG. 2), an unbroken packaging zone remains, situated between the two partially detachable packaging sections 4, which gives the packaging sufficient rigidity to manipulate the rest of the containers with ease owing to lateral maintenance of the bottles 2.

Figure 3:
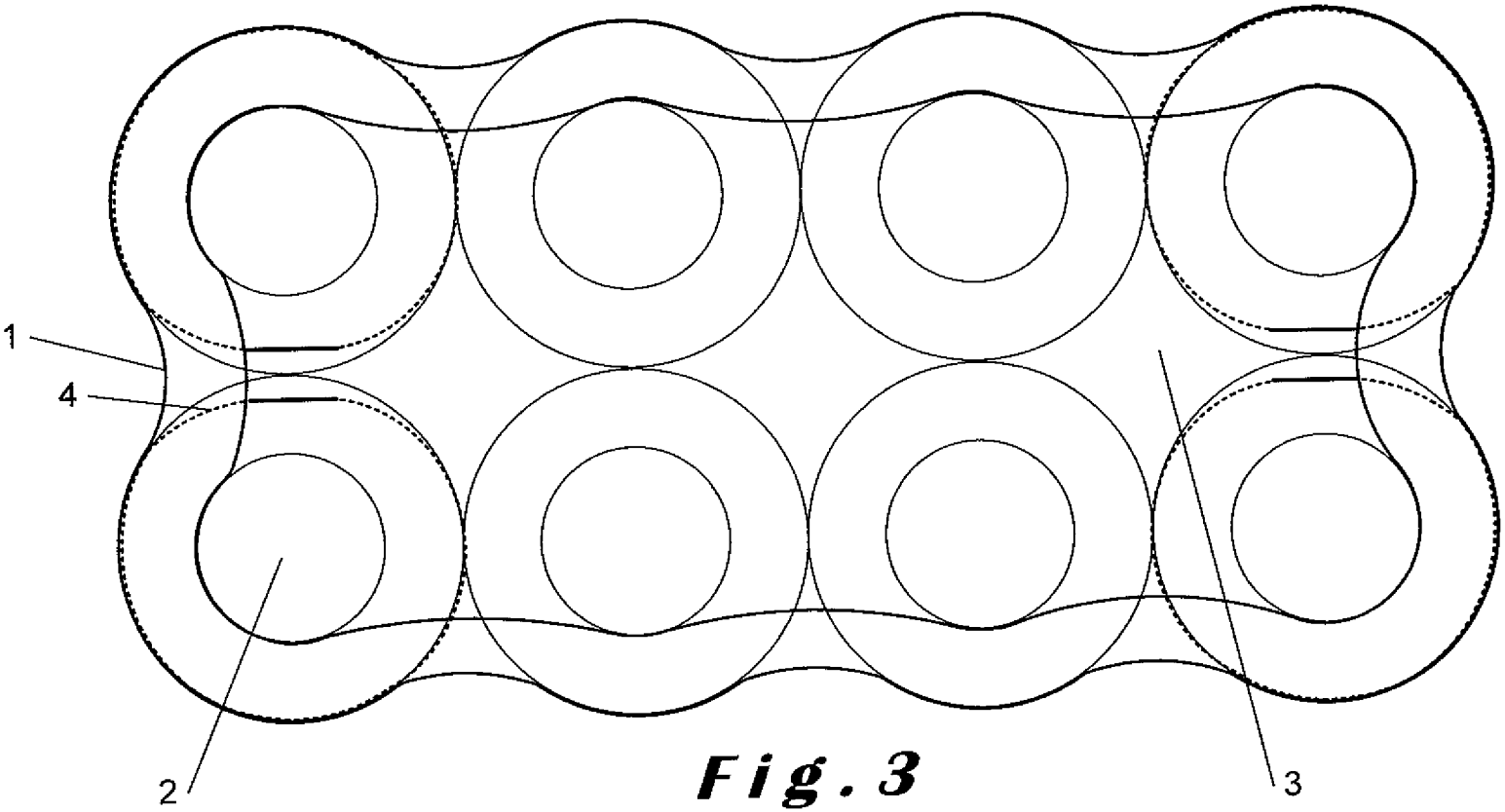
FIG. 3 is a top diagrammatic view of FIG. 1, showing a first zone situated at the opening of the bottles.

FIG. 3 is a diagrammatic top view of FIG. 1, and therefore comprises all of the elements described in FIG. 1. This figure makes it possible to show the zone that will remain on the first zone after breaking the incisions containing a perforation series and making it possible to preserve lateral maintenance of the bottles 2.

FIG. 4 shows a packaging blank according to the invention comprising four incisions comprising a series of perforations forming four partially detachable sections 4 situated on the periphery of a first zone 3.

The manufacture of the packaging blank comprises unwinding a shrink film on a conveyor belt. The shrink film is partially incised beforehand, using a tracing wheel, using a cutting punch, or by laser, four times in order to delimit four partially detachable packaging sections 4 located on the periphery of the first zone 3. Each incision has a size larger than or equal to the section of the container 2. Next, the containers 2 are positioned in parallel rows on the conveyor belt in order to cover them. Said containers may be covered using a bundler that makes it possible to wind said previously perforated shrink film (four incisions according to FIG. 4), thus forming four shrink film sections 4 around said containers on the first zone 3. Lastly, the assembly comprising the packaging and the containers passes through a heating zone, for example a furnace, in order to shrink said film around the containers.

FIG. 5 illustrates a top diagrammatic view of a packaging 1, comprising all of the elements described in FIG. 3 except that the containers are cans 2. The packaging 1 illustrated in FIG. 5 comprises twelve cans 2 in parallel rows. There are 10 partially detachable packaging sections 4. When a can 2 is removed from the packaging 1 in a direction substantially oriented from the lower part toward the upper part of the packaging, the rest of the packaging 1 remains rigid enough to keep the rest of the cans 2 present in the packaging 1 owing to lateral maintenance thereof.

FIG. 6 comprises all of the elements described in FIG. 2 except that the containers are cans 2. FIG. 6 shows a top diagrammatic view of a packaging 1 that comprises twenty-four cans 2 in parallel rows. This embodiment illustrates eight partially detachable packaging sections 4. The shape of the incisions makes it possible to remove a larger quantity of cans.

It is understood that the present invention is in no way limited to the embodiments described above and that modifications may be made thereto without going beyond the scope of the appended claims.

The invention claimed is:

1. A method for manufacturing a shrink packaging for a series of containers having a lower part and an upper part, comprising the following steps:

unwinding a shrink film on a conveyor belt;

positioning the containers on said conveyor belt, in parallel rows;

bundling the containers using said shrink film comprising at least one first zone confined to a top side of said upper part, covering said upper part of said containers and containing a peripheral area which surrounds a central zone of said at least one first zone, thus forming a shrink film coating around the containers; and heat treating said shrink film in order to keep the containers tight against each other;

an incision step along a trajectory corresponding to at least one incision line on said first zone of said shrink film, comprising a series of perforations forming at least one at least partially detachable section arranged to remove at least one of the containers in a direction substantially oriented from the lower part of said at least one of the containers toward the upper part of said at least one of the containers, said at least one at least partially detachable packaging section having a size larger than or equal to the section of said at least one of the containers to be removed, said at least one at least partially detachable section being located on the peripheral area of said at least one first zone such that said central zone of said at least one first zone is free of said at least one at least partially detachable packaging section having a size larger than or equal to the section of said at least one of the containers to be removed and configured to remain on said first zone before and after breaking the incision line, wherein said incision step is performed before said unwinding of the shrink film.

2. The method according to claim 1, wherein said incision made using a tracing wheel articulated on an arm that can be manipulated to trace said trajectory, using a cutting punch, or by laser.

3. The method according to claim 1, further comprising printing a pattern on said film before said unwinding said shrink film.

* * * * *